US008430034B2

(12) United States Patent
Mutascio

(10) Patent No.: US 8,430,034 B2
(45) Date of Patent: Apr. 30, 2013

(54) COMBUSTIBLE CARTRIDGE CASED AMMUNITION ASSEMBLY

(75) Inventor: Enrico R. Mutascio, Palm Springs, CA (US)

(73) Assignee: Armtec Defense Products Co., Coachella, CA (US)

( * ) Notice: Subject to any disclaimer, the term of this patent is extended or adjusted under 35 U.S.C. 154(b) by 0 days.

(21) Appl. No.: 13/424,328

(22) Filed: Mar. 19, 2012

(65) Prior Publication Data

US 2012/0291653 A1 Nov. 22, 2012

Related U.S. Application Data

(62) Division of application No. 11/651,147, filed on Jan. 8, 2007, now Pat. No. 8,146, 502.

(60) Provisional application No. 60/757,142, filed on Jan. 6, 2006.

(51) Int. Cl.
*F42B 5/18* (2006.01)

(52) U.S. Cl.
USPC ..... 102/431

(58) Field of Classification Search ..... 102/431
See application file for complete search history.

(56) References Cited

U.S. PATENT DOCUMENTS

| | | | | | |
|---|---|---|---|---|---|
| 3,485,170 | A * | 12/1969 | Scanlon | ..... | 102/432 |
| 3,658,008 | A * | 4/1972 | Larson | ..... | 102/431 |
| 3,705,549 | A * | 12/1972 | Quinlan et al. | ..... | 102/431 |
| 4,015,527 | A * | 4/1977 | Evans | ..... | 102/433 |
| 4,604,954 | A * | 8/1986 | Clarke et al. | ..... | 102/434 |
| 4,802,415 | A * | 2/1989 | Clarke et al. | ..... | 102/434 |
| 5,138,949 | A * | 8/1992 | Swartout et al. | ..... | 102/431 |
| 5,289,776 | A * | 3/1994 | Thiesen et al. | ..... | 102/431 |
| 5,335,599 | A * | 8/1994 | Thiesen et al. | ..... | 102/431 |
| 5,400,714 | A * | 3/1995 | Thiesen et al. | ..... | 102/431 |
| 5,400,715 | A * | 3/1995 | Roach et al. | ..... | 102/443 |
| 5,443,009 | A * | 8/1995 | Thiesen et al. | ..... | 102/443 |
| 5,563,365 | A * | 10/1996 | Dineen et al. | ..... | 102/431 |
| 5,610,365 | A * | 3/1997 | Thiesen | ..... | 102/431 |
| 5,650,589 | A * | 7/1997 | Thiesen | ..... | 102/431 |
| 5,841,062 | A * | 11/1998 | Manole et al. | ..... | 102/431 |
| 5,907,121 | A * | 5/1999 | Fritze | ..... | 102/530 |
| 6,158,348 | A * | 12/2000 | Campoli | ..... | 102/443 |
| 6,745,697 | B2 * | 6/2004 | Haak et al. | ..... | 102/472 |
| 6,748,870 | B2 * | 6/2004 | Heidenreich et al. | ..... | 102/431 |
| 6,901,866 | B2 * | 6/2005 | Mutascio et al. | ..... | 102/431 |
| 2003/0033953 | A1 * | 2/2003 | Haak et al. | ..... | 102/431 |
| 2003/0121444 | A1 * | 7/2003 | Mutascio et al. | ..... | 102/431 |
| 2007/0289474 | A1 * | 12/2007 | Mutascio | ..... | 102/431 |
| 2009/0145320 | A1 * | 6/2009 | Harrison | ..... | 102/204 |
| 2009/0266263 | A1 * | 10/2009 | Quesenberry et al. | ..... | 102/431 |

* cited by examiner

*Primary Examiner* — Samir Abdosh
(74) *Attorney, Agent, or Firm* — Perkins Coie LLP

(57) ABSTRACT

A combustible cartridge assembly is described. The assembly of one embodiment includes a projectile, a body having a first end portion coupled to the projectile and a second end portion opposite the first end portion. The body is made of a combustible material configured to be consumed upon firing the ammunition round assembly. A sleeve is at least partially contained within the base. The sleeve has a free end portion radially to adjacent to and coupled to the second end portion of the body. The sleeve and the body defines an interior area configured to contain a combustible propellant. A non-combustible base at least partially is coupled to the sleeve and is adjacent to the second end portion of the body.

26 Claims, 4 Drawing Sheets

COMBUSTIBLE CARTRIDGE CASED AMMUNITION ASSEMBLY

CROSS-REFERENCE TO RELATED APPLICATIONS

The present application is a divisional of U.S. patent application Ser. No. 11/651,147, filed Jan. 8, 2007 and titled COMBUSTIBLE CARTRIDGE CASED AMMUNITION ASSEMBLY, which issued as U.S. Pat. No. 8,146,502 on Apr. 3, 2012, and which claims priority to and the benefit of Provisional U.S. Patent Application No. 60/757,142, filed Jan., 6, 2006 and titled COMBUSTIBLE CARTRIDGE CASED AMMUNITION ASSEMBLY, each of which is hereby incorporated in its entirety by reference thereto.

TECHNICAL FIELD

This document describes a configuration for ammunition, including large-bore ammunition having combustible cartridge cases.

BACKGROUND

A combustible cartridge case (CCC) typically includes two main structural components. The first is an elongated generally cylindrical combustible cartridge case body that has an interior area containing a propellant bed. The case body has a bottom dome portion to interface with a composite metal/elastomer case base. The second is an adapter with a tapered shoulder to interface with a projectile. The adapter can be manufactured from combustible materials or inert materials. The adapter and the body are affixed together by an adhesive at an angled lap-type joint known as a skive joint. The angled joining surfaces expose more material to the adhesive than a butt-type joint for greater structural strength.

The CCC configuration allows complex propellant bed geometries and integration with projectiles that have deep intrusions into the propellant bed (e.g., armor-piercing fin-stabilized discarding-sabot kinetic energy type projectiles). A typical assembly sequence includes assembling a projectile with an adapter, inverting the assembly to a nose-down orientation, and disposing a propellant bed to the intruding projectile. Meanwhile, the CCC body is assembled to a composite metal/elastomer case base. The base incorporates a cartridge head-spacing feature (e.g., a rim). Finally, the case base/CCC body assembly is attached to the projectile/adapter/propellant bed assembly at the skive joint with an adhesive.

The attachment of the case base/CCC body assembly to the projectile/adapter/propellant bed assembly is often used to establish and control the overall length of the complete cartridge. If the partially assembled cartridge needs to be shortened during manufacturing, the cartridge can be axially compressed so as to overdrive the skive joint, thereby shortening the overall length of the completed cartridge into an acceptable range. As a result, the overdriven skive joint forms a rear-facing lip as the adapter (female) expands beyond the CCC body (male), which creates a risk that the cartridge may be damaged. For example, sliding the complete cartridge across any discontinuity can cause the adapter lip be caught, torn, and possibly expose the propellant bed.

DETAILED DESCRIPTION

Figure 1:
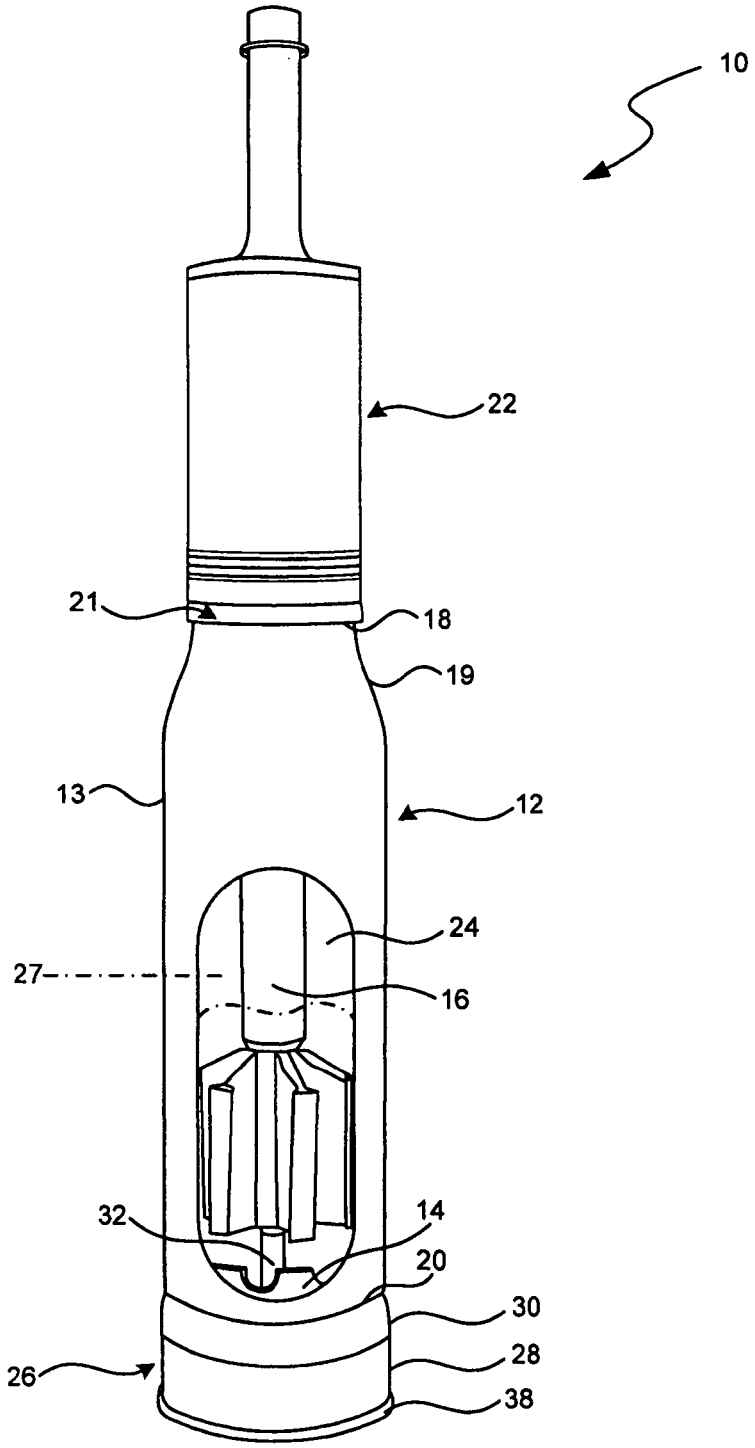
FIG. 1 is a partially cut-away isometric view of a Combustible Cartridge Cased (CCC) ammunition assembly in accordance with an embodiment of the present invention.
Figure 2:
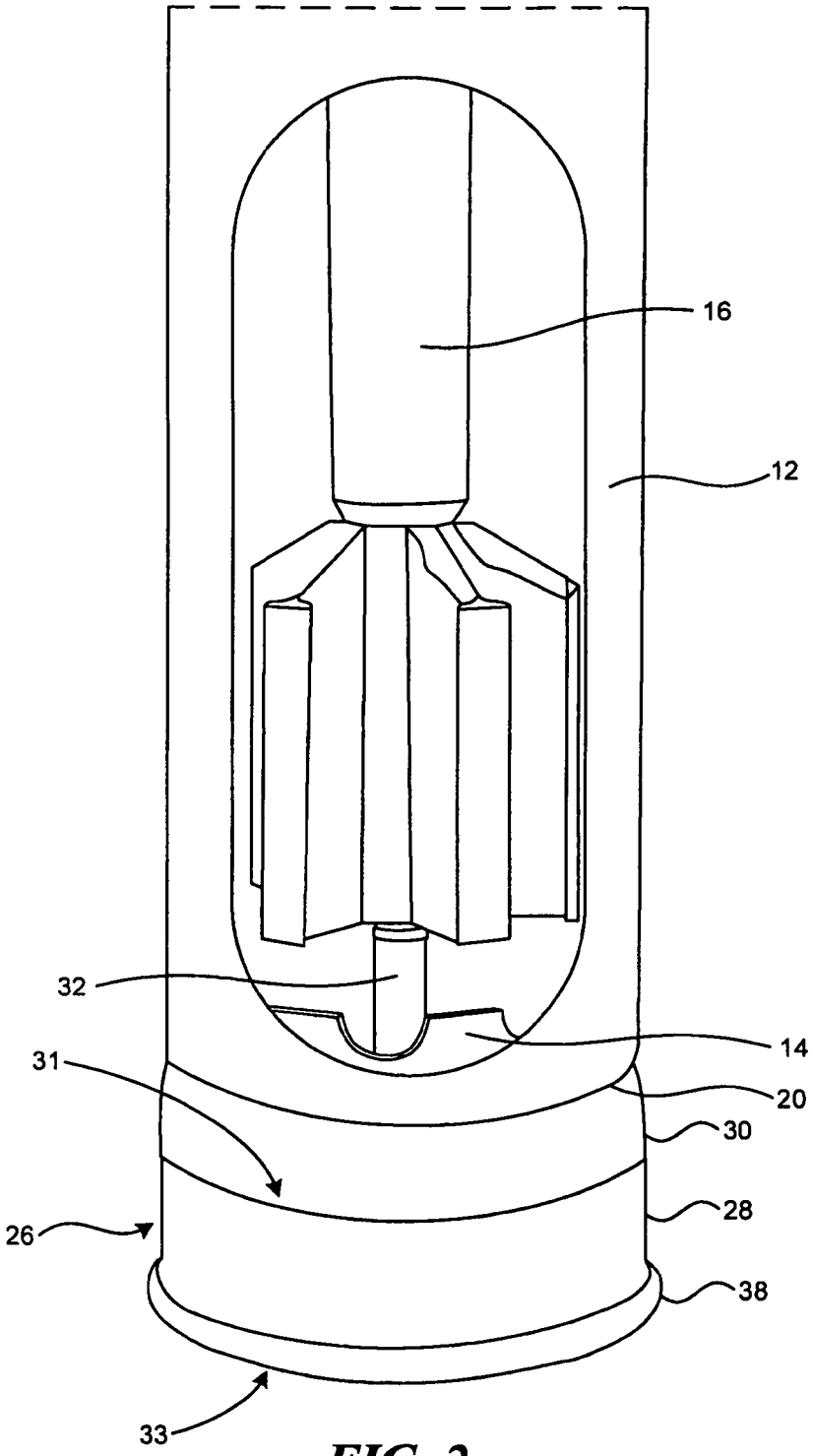
FIG. 2 is an enlarged, partially cut-away isometric view of the CCC ammunition assembly of FIG. 1.

A combustible cartridge cased ammunition round assembly in accordance with the present invention overcomes drawbacks of the prior art and provides other benefits. Embodiments of the present invention are disclosed below and shown in the attached Figures. FIGS. 1 and 2 are partially cut-away isometric views of a Combustible Cartridge Cased (CCC) ammunition round assembly 10 in accordance with an embodiment of the present invention. FIGS. 1 and 2 show for illustrative purposes the CCC ammunition round assembly 10 having a projectile 16, a combustible body 12, a sleeve 14 disposed partially inside the body 12, and a base 26 that forms a closed-ended bottom of the CCC ammunition round assembly 10. The body 12 and the sleeve 14 define an interior area 24 that contains a propellant charge 27 (partially shown in phantom lines for purposes of clarity) that can be ignited by an ignition device (e.g., a primer 32) upon firing. The CCC ammunition round assembly 10 can optionally include projectile assemblies, such as a sabot assembly housed in a housing 22.

Figure 3:
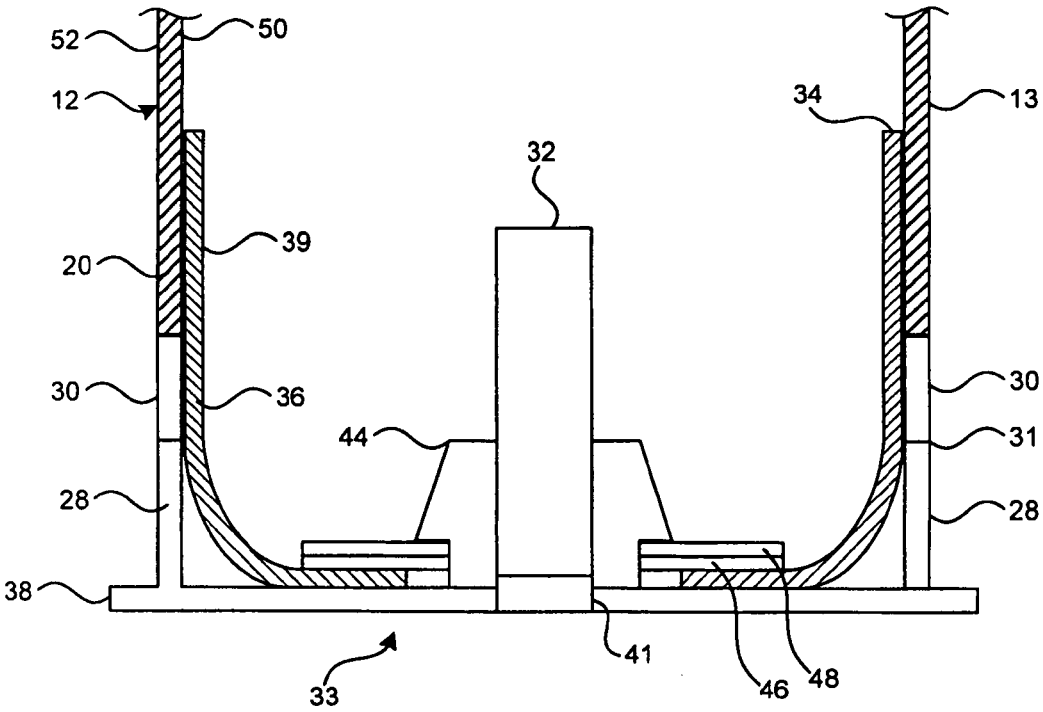
FIG. 3 is an enlarged partial cross-sectional view of the case body/sleeve/case base assembly of the CCC ammunition assembly of an embodiment.
Figure 4:
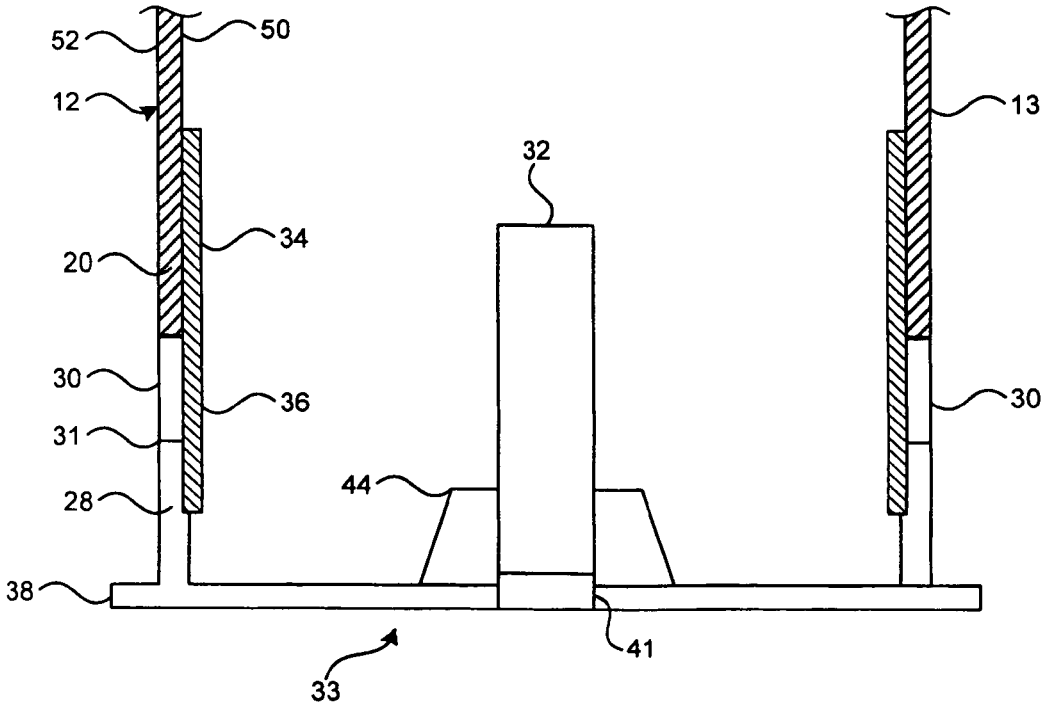
FIG. 4 is an enlarged partial cross-sectional view of the case body/sleeve/case base assembly of the CCC ammunition assembly of another embodiment.
Figure 5:
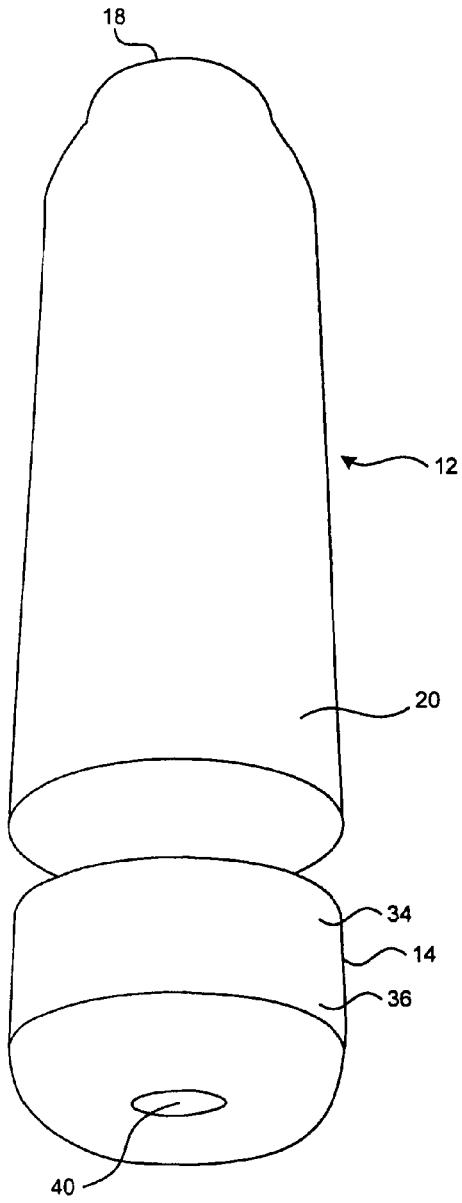
FIG. 5 is a partially exploded isometric view of the case body and the sleeve of the CCC ammunition assembly of an embodiment with a sleeve spaced apart from the case body.
Figure 6:
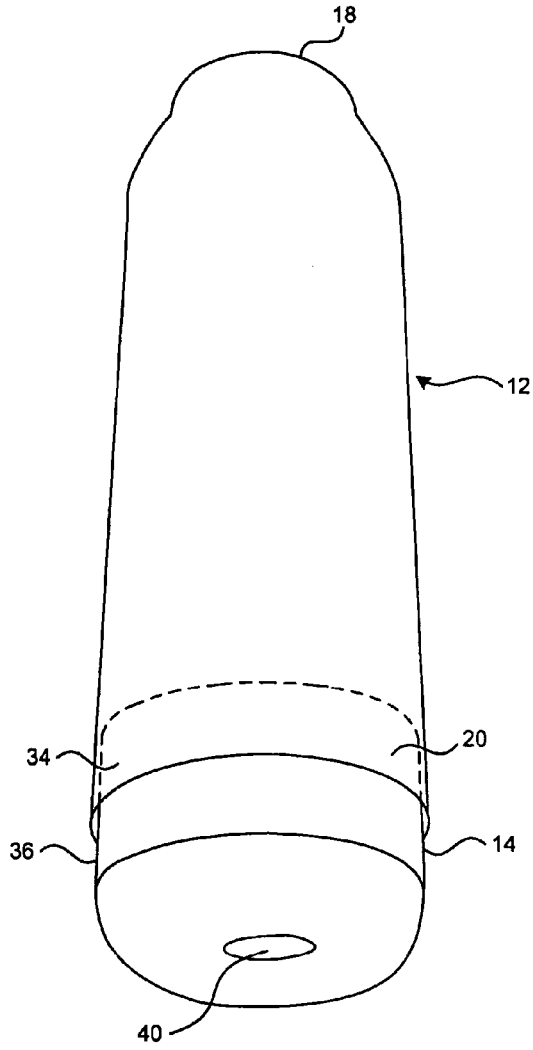
FIG. 6 is an isometric view of the sleeve and case body of FIG. 5 shown in an assembled configuration.

The body 12 of the illustrated embodiment is a generally cylindrical body having a sidewall 13 extending from a first end portion 18 to a second end portion 20. The first end portion 18 has a substantially continuous tapered case shoulder 19 and an open end 21 (sometimes referred to as a case "mouth") shaped and sized to removably receive at least a portion of the projectile 16. The open end 21 of the first end portion 18 can have various features for engaging the projectile 16. For example, the open end 21 of the first end portion 18 can include threads, holes, grooves, or notches for interface with the projectile 16 with any suitable interface, such as bolted, glued, interference-fit, lipped, clamped, threaded, and/or notched, or other interface. As best seen in FIGS. 3 and 4, the second end portion 20 of the body 12 has a generally circular cross section with an inner body diameter corresponding to an inner surface 50 and an outer body diameter corresponding to an outer surface 52 of the sidewall 13.

The body 12 is constructed from a combustible cartridge material that will be substantially fully consumed when the ammunition round assembly 10 is fired in a gun or other firing device. In one embodiment, the body 12 is fabricated from a molded resinated, short-fiber composite whose main constituent is nitrocellulose. In another embodiment, the body 12 is constructed from a laminated material having an inner layer of an energetic combustible material and an outer layer of an inert material. The inert layer can be integrated with the energetic layer using various techniques. In one embodiment, the inert layer is integrated with the energetic layer by a secondary pre-forming operation. During fabrication, a pre-forming tool is first immersed in an energetic formulation to form the energetic substrate. Then, the energetic substrate is selectively immersed in an inert formulation to form and integrate with the inert layer. This selectivity may be achieved by, for example, masking and/or selective immersion. After the pre-forming operation, the body 12 is molded to complete the integration of the two layers. In another embodiment, the body 12 is constructed with two pre-forms. For example, a pre-form fabricated from the energetic material and an inert shield pre-form fabricated from the inert material. The pre-forms may have designed features, such as mechanical locking features that fasten the two pre-forms when the two pre-forms are mated together prior to molding.

The external surface of the body 12 can be optionally coated with an environmentally protective coating containing, for example, polyvinyl alcohol and polyurethane. This protective coating is also consumable when the ammunition round assembly 10 is fired. The coating may be applied to the completely assembled ammunition round assembly 10 or individually to the body 12 and the sleeve 14.

The sleeve 14 is a generally cylindrical body that at least partially overlaps with and attaches to second end portion 20 of the body 12 generally adjacent to the base 26. In the illustrated embodiment, the sleeve 14 is sized to mate with the body 12 in a lap-joint configuration wherein a portion of the sleeve 14 directly attaches to the second end portion 20 of the body 12. For example, the sleeve's outer diameter can approximately correspond to the body's inner diameter at the second end portion 20 such that the sleeve 14 can be partially inserted into the second end portion 20 of the body 12 in the overlapping configuration. As a result, the second end portion 20 of the body 12 and the sleeve 14 overlap to define the interior area 24 configured to retain a combustible propellant. The sleeve 14 can incorporate form features at or near the top edge portion, such as scallops (as shown in FIGS. 1 and 2), holes, or contours that provide enough of the sleeve to connect to the body's second end portion 20 while exposing a greater area of the body's combustible material to the gun gases during firing. This exposure minimizes the risk that unburned residue remains after firing.

The sleeve 14 of the illustrated embodiment is constructed from a suitable material with sufficient strength and durability to withstand forces applied thereto during normal or rough handling of the ammunition round assembly 10. In one embodiment, the sleeve 14 is fabricated from the same material as the body 12. In another embodiment, the sleeve 14 is fabricated from a similar material as the body 12 but is inert to prevent premature burning when the firing chamber contains hot residual. In yet another embodiment, the sleeve 14 is fabricated with a non-combustible material, for example, steel, such that after firing, the sleeve 14 can be recovered with the base 26.

The base 26 engages the sleeve 14 such that the base 26 at least partially isolates the sleeve 14 from the outside environment. In one embodiment, the base 26 includes a metallic cup portion 28 having a closed end 33, an open end 31, and an elastomer ring 30 mated to the open end 31. The closed end 33 of the base 26 provides a solid mounting feature 44 (e.g., a primer boss) for attaching the primer 32 or other ignition device that can ignite the propellant charge. The outside edge of the closed end 33 of the base 26 defines a rim 38 configured for properly locating the CCC ammunition round assembly 10 in a firing chamber of a gun or other firing device. The rim 38 is also configured for removing the base 26 from the firing chamber after the ammunition round assembly 10 has been fired.

FIG. 3 is a partial cross-sectional view of the CCC ammunition round assembly 10 of FIG. 1 in accordance with one embodiment. In the illustrated embodiment, the sleeve 14 has a substantially uniform diameter along a generally cylindrical section 39 of the sleeve 14 and a domed section 41 with a central hole 41 for permitting a primer 32 to extend through the domed section. The sleeve 14 is sized to fit within the cup portion 28 of the base 26, so the central hole 41 of the sleeve 14 fits over the mounting feature 44 of the base 26. The sleeve 14 is securely retained in the base 26 by using a retention device, for example, a spring disc 46 and a snap ring 48. In one embodiment, adhesives can also be used to securely retain the sleeve 14 within the base 26. The primer 32 extends through the base 26 and the central hole 41 in the sleeve 14 to engage the base 26 by, for example, engaging threads of the mounting feature 44. The sleeve 14 and the base 26 engage the body 12 by forming a lap-type joint between an outer surface of the sleeve and an inner surface 50 of the body as illustrated in FIGS. 3 and 4.

FIG. 4 is a partial cross-sectional view of the CCC ammunition round assembly 10 in accordance with another embodiment. The features of this illustrated embodiment are generally similar to the features described above with reference to FIG. 3. The sleeve 14, however, is a generally cylindrical body having two open ends. The first portion 34 of the sleeve 14 engages the body 12 at the second end portion 20 by forming a lap-type joint between an outer surface of the sleeve and an inner surface 50 of the body. The second portion 36 of the sleeve 14 is securely coupled to the base 26 by using an adhesive, friction fit, mechanical fastener, or other securing mechanism that secures the sleeve 14 and an internal surface of the base 26.

In both embodiments described above with reference to FIGS. 3 and 4, the base 26 is adjacent to the second end portion 20 of the body 12 when the sleeve 14, the base 26, and the body 12 are assembled together. In the illustrated embodiment, the second end portion 20 of the body 12 is at least partially abutting the edge of the elastomer ring 30 of the base 26. The second end portion 20 can be positioned to engage the edge of the elastomer ring in a butt joint, so that the edge of the body may partially compress a portion of the elastomer ring 30 to achieve improved sealing of the sleeve 14. In other embodiments, the elastomer ring 30 at least partially encloses the second end portion 20 of the body 12. In further embodiments, the second end portion 20 of the body 12 separates from the elastomer ring 30 by a small distance.

During assembly of one embodiment, the projectile 16 (FIG. 1) is first attached to the first end portion 18 of the body 12. The propellant charge 27 is then disposed in the body 12 through the open second end portion 20 while the body 12 is engaged with the projectile 16. Before the base 26 is coupled to the body 12, the sleeve 14 is securely attached to the base 26. In one embodiment, the sleeve 14 is secured to the base 26 with a retention device, such as a spring disk, a snap ring and/or other retention means. When the sleeve 14 is attached to the base 26, the central hole 40 in the sleeve 14 is adjacent to and coaxially aligned with a primer hole 41 that extends through mounting feature 44 of the base. The primer 32 is then inserted into the primer hole 41 and the central hole 40 in the sleeve 14. In one embodiment, the primer 32 can have a set of exterior threads, and the primer 32 can be screwed into the base 26 so that the external threads mate with the internal threads in the mounting member 44, thereby forming a base/primer/sleeve assembly. Then, the base/primer/sleeve assembly is partially inserted into the second end portion 20 of the body 12, such that the sleeve 14 and the body 12 partially overlap and until the leading edge of the body's second end portion 20 abuts against the elastomer ring 30. Accordingly, the elastomer ring 30 can provide a flexible structure that blocks the primer/base/sleeve assembly from being inserted too far into the body 12 during the assembly process. In one embodiment, the elastomer ring 30 may be compressed a bit by the body if needed to properly size the overall assembly or to properly position the base relative to the body. The interface of the ring 30 and the body 12, however, do not create a radially protruding projection (e.g., a raised lip) that can be caught or damaged during handling, storage, or use of the ammunition assembly 10. The first portion 34 of the sleeve 14 and the body 12 are then secured together, such as by applying an adhesive at the lap joint or by using another securing device, mechanism, or means.

The lap joint between the sleeve 14 and the body 12 permits final adjustments of the overall length of the CCC ammunition round assembly 10 without the risk of overdriving the joint to result in a raised lip. In one embodiment, the CCC ammunition round assembly 10 can be lengthened during the assembly process by reducing the amount of the sleeve 14 within the body 12 prior to fixing the sleeve and body together. In another embodiment, the CCC ammunition round assembly 10 can be shortened by pushing the sleeve 14 further into the body 12, thereby increasing the amount of the sleeve's first portion 34 that engages the second end portion 20 of the body 12. In either embodiment, the second end portion 20 of the body 12 is adjacent to the base 26.

The assembly process for manufacturing the CCC ammunition assembly 10 is simple, fast, and easy, thereby reducing the manufacturing costs. When the CCC ammunition assembly 10 is assembled, the lap joint adjacent to the base can be sealed and protected by the elastomer ring 30 of the base 26. The resulting interface between the base, the sleeve and the body provides a smooth surface transition. Further, the location of the lap-type joint adjacent to the base is in a low-stress area and is protected by the elastomer ring 30 and the rim 38 of the base 26, so that the assembled CCC ammunition round assembly 10 is extremely durable for use in the harshest environments.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

I claim:

1. A method for assembling a combustible-cased ammunition round assembly, comprising:

coupling a projectile with a combustible cartridge body, the body having an end portion opposite the projectile;

attaching an engagement member to a non-combustible base such that an engagement portion of the engagement member projects beyond an edge of the base;

positioning the engagement portion radially adjacent to the end portion of the body such that the end portion of the body is adjacent to the edge of the base; and adjusting an overall length of the combustible-cased ammunition round assembly by adjusting an amount of overlap between the engagement portion and the end portion of the body.

2. The method of claim 1, further comprising forming a lap joint between the engagement portion of the engagement member and the end portion of the body.

3. The method of claim 1 wherein positioning the engagement portion includes positioning the engagement portion radially inward of the end portion.

4. The method of claim 1 wherein adjusting an overall length of the combustible-cased ammunition round assembly includes increasing an amount of overlapping between the engagement portion of the engagement member and the end portion of the body.

5. The method of claim 1 wherein the base is cup-shaped with an open end defined by the engagement portion, and attaching the engagement member includes placing the cup-shaped sleeve into the base.

6. The method of claim 1 wherein the base includes a metallic base portion and a flexible ring, and wherein attaching the engagement member includes positioning the metallic portion of the base around the engagement member such that the flexible ring at least partially encloses the engagement portion and is adjacent to the end portion of the body.

7. An assembly method for a combustible-cased ammunition round, comprising:

connecting a projectile to a first end portion of combustible cartridge body, the body having a second end portion opposite the first end portion and an interior area between the first and second end portion;

disposing a propellant into the interior area of the body through the second end portion after the projectile is connected to the first end portions;

attaching an engagement sleeve to a non-combustible base such that an engagement portion of the engagement sleeve projects beyond an edge of the base, the engagement sleeve being attached to the base while out of engagement with the body;

positioning the engagement portion radially adjacent to the second end portion of the body after the engagement sleeve is attached to the base and such that the second end portion of the body overlaps the engagement portion and is adjacent to the edge of the base; and adjusting an overall length of the combustible-cased ammunition round by adjusting an amount of overlap between the engagement portion of the sleeve and the end portion of the body.

8. The method of claim 7, further comprising forming a lap joint between the engagement portion of the engagement member and the second end portion of the body.

9. The method of claim 7 wherein positioning the engagement portion includes positioning the engagement portion radially inward of the second end portion.

10. The method of claim 7 wherein adjusting an overall length of the combustible-cased ammunition round includes increasing the amount of overlap between the engagement portion of the engagement sleeve and the second end portion of the body.

11. The method of claim 7 wherein the engagement sleeve is cup-shaped with an open end defined by the engagement portion, and attaching the engagement sleeve includes placing the cup-shaped sleeve into the base with the open end exterior of the base.

12. The method of claim 7 wherein the base includes a metallic base portion and a flexible ring, and wherein attaching the engagement sleeve includes positioning the metallic portion of the base around the engagement sleeve such that the flexible ring at least partially encloses the engagement portion, and wherein positioning the engagement portion includes positioning the engagement portion relative to the second end portion of the body with the second end portion abutting the flexible ring.

13. The method of claim 7 wherein the base has a primer aperture, and wherein attaching the engagement sleeve includes attaching the engagement sleeve to the base with the engagement sleeve substantially coaxially aligned with the primer aperture.

14. The method of claim 13, further comprising disposing a primer in the primer aperture in the base before the positioning of the engagement portion radially adjacent to the second end portion of the body.

15. The method of claim 7 wherein the base has a primer aperture, and the method further comprising disposing a primer in the primer aperture in the base before the positioning of the engagement portion radially adjacent to the second end portion of the body.

16. The method of claim 7 wherein the base has a mounting feature, and wherein attaching an engagement sleeve includes positioning the engagement sleeve in the base with a portion of the engagement sleeve adjacent to the mounting feature, and securing a retention device to the mounting feature with the portion of the engagement sleeve being retained between the retention device and the base to retain the engagement sleeve in the base.

17. The method of claim 7 wherein the base has a primer aperture therein and a boss surrounding the aperture, and wherein attaching the engagement sleeve includes positioning the engagement sleeve in the base with a portion of the engagement sleeve adjacent to the boss, and securing a retention device to the boss with the portion of the engagement sleeve being retained between the retention device and the base.

18. The method of claim 7 wherein the base has a primer aperture, and the attaching the engagement sleeve to the non-combustible base includes positioning the engagement sleeve substantially in coaxial alignment with the primer aperture, and the method further comprises disposing a primer in the primer aperture.

19. An assembly method for a combustible-cased ammunition round, comprising:

connecting a projectile to a first end portion of a combustible cartridge body, the body having a second end portion opposite the first end portion and an interior area between the first and second end portions;

disposing a propellant into the interior area of the body through the second end portion after the projectile is connected to the first end portion;

positioning an engagement sleeve in a non-combustible base having a mounting feature, wherein a base portion of the engagement sleeve is positioned adjacent to the mounting feature;

securing the engagement sleeve to the base with a retention device that engages the mounting feature, wherein the base portion of the engagement sleeve is retained between the retention device and the base, and wherein an engagement portion of the engagement sleeve projects beyond an edge of the base, the engagement sleeve being secured to the base while out of engagement with the body; and positioning the engagement portion radially inward and adjacent to the second end portion of the body after disposing the propellant into the interior area and such that the second end portion of the body overlaps the engagement portion and is adjacent to the edge of the base whereby an overall length of the combustible-cased ammunition round can be adjusted.

20. The method of claim 19, further comprising adjusting an overall length of the combustible-cased ammunition round by adjusting an amount of overlap between the engagement portion of the engagement sleeve and the end portion of the body.

21. The method of claim 19, further comprising increasing the amount of overlap between the engagement portion of the engagement sleeve and the second end portion of the body.

22. The method of claim 19, further comprising lengthening the overall length of the combustible-cased ammunition round by decreasing the amount of overlap between the engagement portion of the engagement sleeve and the end portion of the body.

23. The method of claim 19 wherein the engagement sleeve is cup-shaped with an open end defined by the engagement portion, and positioning the engagement sleeve includes placing the cup-shaped sleeve into the base with at least a portion of the engagement portion projecting from the base.

24. The method of claim 19 wherein the base includes a metallic base portion and a flexible ring, and wherein positioning the engagement sleeve includes positioning the metallic portion of the base around the engagement sleeve such that the flexible ring at least partially encloses the engagement portion, and wherein positioning the engagement portion includes positioning the engagement portion relative to the second end portion of the body with the second end portion abutting the flexible ring.

25. The method of claim 19 wherein the base has a primer aperture, and the method further comprising disposing a primer in the primer aperture in the base before the positioning of the engagement portion radially adjacent to the second end portion of the body.

26. The method of claim 19, further comprising fixing with an adhesive the engagement portion to the second end portion of the body that overlaps with the engagement portion.

* * * * *